US005505060A

United States Patent [19]

Kozinski

[11] Patent Number: 5,505,060

[45] Date of Patent: Apr. 9, 1996

[54] INTEGRAL EVAPORATOR AND SUCTION ACCUMULATOR FOR AIR CONDITIONING SYSTEM UTILIZING REFRIGERANT RECIRCULATION

[76] Inventor: Richard C. Kozinski, 27671 Dowland, Warren, Mich. 48092

[21] Appl. No.: 311,550

[22] Filed: Sep. 23, 1994

[51] Int. Cl.[6] ..... F25B 39/04

[52] U.S. Cl. ..... 62/503; 165/132

[58] Field of Search ..... 165/132; 62/503, 62/509

[56] References Cited

U.S. PATENT DOCUMENTS

| | | | |
|---|---|---|---|
| 2,081,303 | 5/1937 | Karmazin | 165/132 X |
| 2,105,121 | 1/1938 | Karmazin | 165/132 X |
| 2,159,251 | 5/1939 | Brizzolara | 62/115 |
| 2,164,081 | 6/1939 | Phillips | 62/503 |
| 3,084,523 | 4/1963 | Bottum et al. | 62/296 |
| 3,087,312 | 4/1963 | White | 62/241 |
| 3,264,837 | 8/1966 | Harnish | 62/117 |
| 3,381,487 | 5/1968 | Harnish | 62/117 |
| 3,648,480 | 5/1972 | Watts | 62/268 |
| 3,766,748 | 10/1973 | Bottum et al. | 62/243 |
| 3,977,205 | 8/1976 | Dreisziger et al. | 62/117 |
| 4,187,695 | 1/1980 | Schumacher | 62/503 |
| 4,794,765 | 6/1989 | Carella et al. | 62/512 |
| 4,905,480 | 3/1990 | Bostrom | 62/310 |
| 4,909,046 | 5/1990 | Johnson | 62/244 |
| 5,036,679 | 8/1991 | Zlobinsky et al. | 62/470 |
| 5,076,065 | 12/1991 | Brogan | 62/91 |
| 5,170,638 | 12/1992 | Koenig et al. | 62/204 |

FOREIGN PATENT DOCUMENTS

| | | | |
|---|---|---|---|
| 3087572 | 4/1991 | Japan | 62/509 |

OTHER PUBLICATIONS

Orifice/Accumulator/Clutch Cycle, "A Simplified Refrigerant Control System", Harrison Radiator Division, Lockport, New York, May 13, 1971.

Report No. 19276.1 of Chrysler Corporation, Engineering Office, Entitled "Capillary Tube Refrigerant Expansion Device", Dated Sep. 5, 1967, Author Richard C. Kozinski.

*Primary Examiner*—William E. Wayner

*Attorney, Agent, or Firm*—Dykema Gossett

[57] ABSTRACT

An evaporator of the plate-fin construction has attached a formed housing which together with the evaporator end plate comprises a suction accumulator. A liquid conduit passes through the accumulator and induces fluid from the accumulator into the evaporator via a venturi located in the conduit. A tube inserted into one tank of the evaporator is in direct connection to the accumulator and increases storage capacity of the accumulator. A field removable filter-drier assembly is installed in the exit tank or compartment of the evaporator. A baffle is located in the accumulator section and separates liquid from gas and allows mostly gas with entrained oil to flow to the compressor. A secondary flow path which opens under low charge conditions aids in oil return to the compressor.

15 Claims, 3 Drawing Sheets

INTEGRAL EVAPORATOR AND SUCTION ACCUMULATOR FOR AIR CONDITIONING SYSTEM UTILIZING REFRIGERANT RECIRCULATION

BACKGROUND OF THE INVENTION

An automobile air conditioning system is comprised of a compressor, a condenser, a restrictor, an evaporator, and an accumulator connected in an operative fashion or circuit. In prior art systems the evaporator is connected to the accumulator via a fluid line. The accumulator is usually mounted in the engine compartment of the vehicle. The function of the accumulator is to store or release refrigerant as required by system operating conditions. Also the accumulator stores an extra supply of refrigerant to make up for future system leakage. Another function of the accumulator is to separate liquid from gaseous refrigerant emanating from the evaporator. A non removable drier is usually incorporated in the accumulator. Prior art accumulators generally utilize a U-tube design in the outlet conduit within the shell which leads to the compressor suction line. This U-tube has a small opening near its lowest point which allows liquid containing oil to be drawn into the refrigerant flowing to the compressor. This "oil bleed hole" as it is commonly called is necessary for oil recovery. Without an "oil bleed hole" most of the system oil would end up in the accumulator thereby resulting in lack of lubrication to the compressor and causing its subsequent failure.

Most compressors in automotive use today require a continuous flow of oil for adequate lubrication since these compressors have no oil sump. Several decades ago compressors utilized the "oil sump design" but cost, size and extra weight caused its elimination. The oil flow to the compressor is not only from this "oil bleed hole" but also in the oil entrained in the suction gas.

The liquid refrigerant circulated from the oil bleed hole is detrimental to system performance as additional refrigerant must be compressed and condensed which has accomplished no cooling effect in the evaporator. This extra liquid flow results in more power to drive the compressor and reduced compressor capacity especially at idle and low speed hot ambient conditions where the compressor lacks capacity for maximum cooling as allowed by the evaporator coil anti-freeze control point. At higher speeds the head pressure is raised by the excess flow but cooling performance does not usually suffer since the compressor capacity is greater than evaporator capacity. This is as compared to a thermostatic expansion valve system which only allows the exact flow to totally vaporize the refrigerant returning to the compressor.

The accumulator provided with a U-tube operates in an acceptable fashion in terms of oil recovery when the accumulator has liquid refrigerant within as it is designed to have. During system operation an oily froth exists due to turbulence of flow and boiling of refrigerant. This aids greatly in entraining oil in the suction gas. However, under low charge conditions where the gas leaving the evaporator has no liquid except for oil this froth tends to be greatly diminished. Now, the accumulator must supply oil primarily via the oil bleed hole. At this condition oil recovery suffers since the oil by itself as compared to being mixed with liquid refrigerant has less tendency to flow into the opening due to lower pressure differential across the opening and higher viscosity and entrained gas. Also a substantial quantity of oil must be deposited in the accumulator to reach the oil bleed hole, which can be located away from the bottom of the accumulator since a screen apparatus which is used requires some clearance.

It would be advantageous to incorporate an integral evaporator-accumulator in one package for purposes of achieving less cost, space, and for ease of installation at the final vehicle assembly plant. It would also be advantageous to eliminate the oil bleed hole and its aforementioned disadvantages and to improve low charge oil recovery. Also, a serviceable filter drier would be a benefit over prior art driers which cannot be replaced without replacing the whole expensive accumulator. Thermal losses would also be reduced by removing the accumulator from the hot engine compartment.

In U.S. Pat. No. 4,794,765, issued Jan. 3, 1989, to Thomas J. Carella et al., the U-tube oil bleed concept is used and the total package is approximately 20% (3") wider than the evaporator by itself. Since space is at a premium in car underpanel locations the extra width is a disadvantage as is the requirement for a separately installed liquid line filter drier which probably negated the cost savings of eliminating the installation labor of a separate accumulator.

Efforts to design a practical integral evaporator-accumulator have been continuing since the advent in automobiles in 1973 of the fixed restrictor refrigerant flow systems by General Motors Corporation. No American built vehicle has as yet commercially incorporated the concept of an integral evaporator-accumulator probably due to size and cost constraints.

U.S. Pat. No. 4,794,765 also discloses refrigerant recirculation from the accumulator to the evaporator. However, the U-tube and oil bleed were still used. One of the features of U.S. Pat. No. 4,794,765 was that "free" cooling would be one result which is grossly exaggerated as the compressor-condenser must create the liquid which is recirculated. Recirculation alone could result in more liquid being returned to the compressor and a subsequent loss in cooling performance. This is due to the fact that the oil bleed would still return the same amount as without recirculation and now the extra liquid emanating from the evaporator to the accumulator must be separated to a greater degree. This does not appear to be the case in U.S. Pat. No. 4,794,765.

Current evaporators used in automobiles generally do not suffer from poor refrigerant distribution due to use of a multiple pass design and coil flooding caused by the liquid return quantity to the compressor. Thus U.S. Pat. No. 4,794,765 offers few advantages and is more costly than the fixed restriction systems which are currently used.

SUMMARY OF THE PRESENT INVENTION

This invention relates to a vapor compression cycle refrigeration system. More particularly, it relates to that portion of the system commonly caused the evaporator and accumulator. Specifically, in an automotive air conditioning system the present invention combines the evaporator and accumulator into one low cost high performance assembly.

The accumulator is formed by joining a half shell of a tank to the evaporator end plate resulting in a relatively small increase in overall size. Improved system performance is accomplished by utilization of recirculation of refrigerant within the assembly via a venturi. Also, thermal losses of prior art devices are eliminated along with reduced suction side pressure drop. This novel assembly eliminates the oil bleed hole and its disadvantages as discussed hereinbefore. Oil return to the compressor is by oil entrainment in the suction gas. Low charge oil return is enhanced over the prior art by use of a baffle or tube which flows fluid at low charge conditions only.

A filter-drier assembly is incorporated in the assembly and may be used to aid oil recovery. This filter-drier is removable in the field. Mother feature is the use of a tube within one tank of the evaporator to increase storage capacity of the accumulator and reduce system operating charge requirement. The concept is adaptable to both vertical and horizontal refrigerant flow plate-fin evaporators which are currently used.

The present invention reduces the prior art separate evaporator and accumulator to one assembly, with the subsequent cost and performance advantages discussed herein. The size of the assembly is maintained at equal or only slightly larger than the prior art evaporator only with adequate charge tolerance.

The basic assembly of the present invention may be manufactured with few and possibly with one brazing operation including the threaded connectors. The filter-drier and the venturi tube of the vertical flow evaporator would be added to the assembly after the brazing-cleaning operation.

The air conditioning system of the present invention having an integral evaporator and suction accumulator results in an improved evaporator and improved system cooling performance which permits downsizing of the evaporator section.

With such a construction the oil bleed hole and U-tube of prior art accumulators are eliminated. The novel system maintains adequate oil return to compressor at normal charge. The system also has improved oil return at low charge compared to a prior art accumulator.

The air conditioning system of the present invention includes a field serviceable filter-drier within the integral evaporator-accumulator assembly which aids in oil recovery to the compressor.

The novel system utilizes refrigerant recirculation within the accumulator-evaporator circuit to prevent oil trapping and to increase heat transfer and transient cooling performance.

With the present invention there is a decrease refrigerant pressure drop through the accumulator compared to the prior art.

Also the present invention is adaptable to vertical and horizontal flow evaporators whether single pass or multiple pass.

DESCRIPTION OF THE PREFERRED EMBODIMENT

Figure 1:
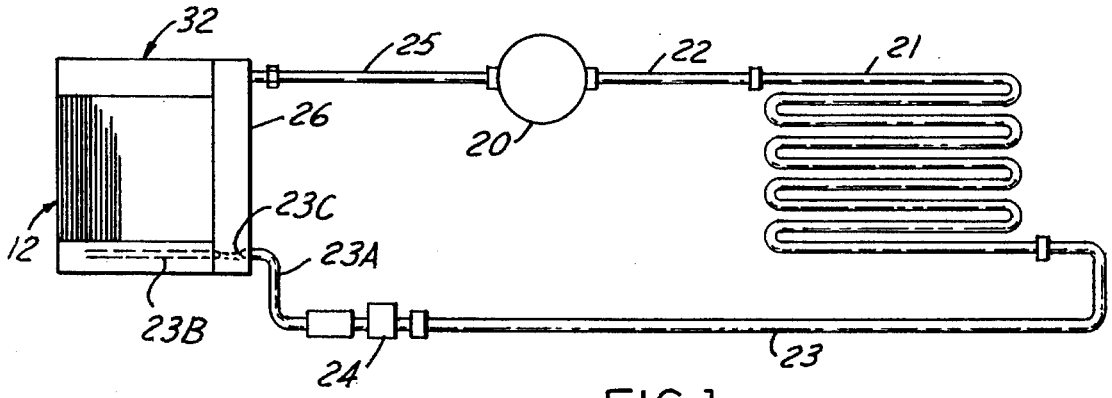
FIG. 1 is a schematic representation of a refrigeration system including the integral evaporator-accumulator assembly.
Figure 2:
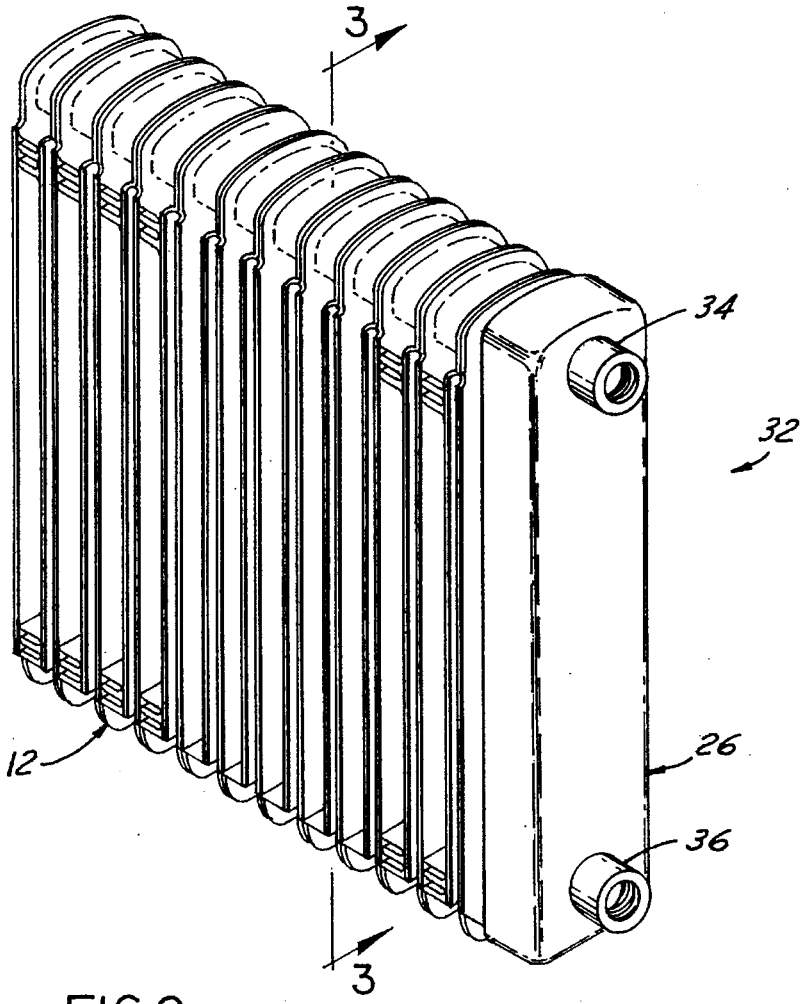
FIG. 2 is an isometric view of the integral vertical flow evaporator-accumulator assembly.

Referring now to the drawings and in particular to FIG. 1 there is shown a refrigeration or vehicle air conditioning system 10 including the novel evaporator-accumulator assembly 32 disclosed herein. In referring to the drawing like numerals shall refer to like parts.

The refrigeration system 10 of FIG. 1 includes a compressor 20 connected to a condenser 21 by a conduit 22. Condenser 21 is connected to the integral evaporator-accumulator assembly 32 by conduits 23 and 23A. A refrigerant metering device or restrictor 24 with suitable screening is disposed between conduits 23 and 23A and operates to regulate the flow of refrigerant from the condenser 21 to the evaporator compartment or section 12 of the evaporator-accumulator assembly 32. Conduit 25 connects the evaporator-accumulator assembly 32 to the compressor suction as shown in FIG. 1. A series of vertical refrigerant flow plate-fins 39 are located in the evaporator section or compartment 12. The plate fins 39 are spaced apart to define paths or channels 33.

In operation relatively high pressure gas from the compressor 20 is discharged via conduit 22 to the condenser 21 where it is condensed by the action of cooler air flowing through the condenser 21. The liquid refrigerant thus formed flows via conduit 23 to the restrictor 24 which may be fixed or variable and is expanded into a mixture of low pressure liquid and gas. This mixture passes into the conduit 23A and flows at relatively high velocity through the venturi 23C in conduit 23B which is in communication with the liquid in the accumulator section 26 of assembly 32.

Figure 3:
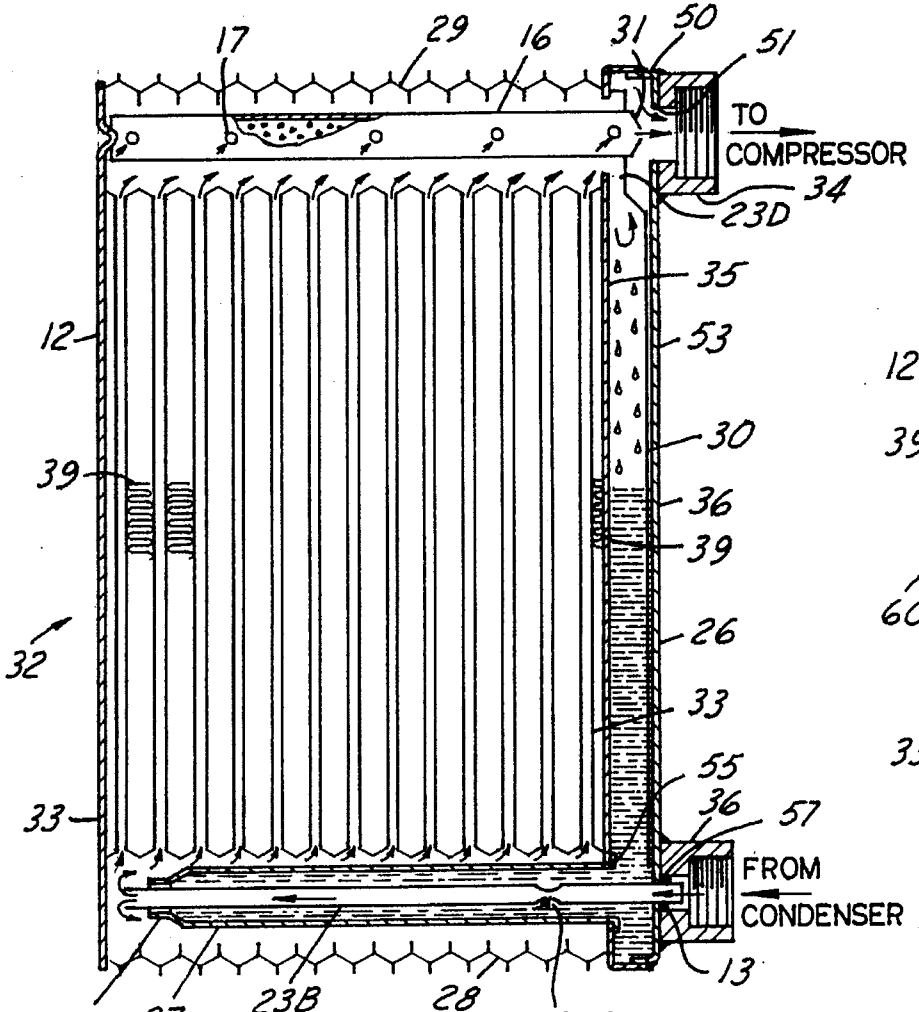
FIG. 3 is a cut-away vertical view of the vertical flow evaporator-accumulator assembly of FIG. 2, partially in section, using a single pass fluid flow path.

The venturi 23C provided in the tube 23B, as shown in FIG. 3, draws refrigerant containing oil from the accumulator section 26 and the resultant flow which is mostly liquid enters the evaporator compartment or bottom tank 28 provided at the bottom of the combined evaporator and suction accumulator assembly 32. The liquid then flows upwardly through the formed channels 33 of the evaporator compartment 12 and enters the upper or top tank or top compartment 29 as mostly a gas. The top compartment or top tank 29 is located above the evaporator compartment 12 and the bottom tank 28 is located at the bottom of the evaporator compartment 12. The compartments 12, 28 and 29 have generally the same length and are provided with a common side wall or end plate 35 as shown in FIG. 3. Some liquid and oil present enters the openings 17 of the filter-drier assembly 16 and this product by pressure differential flows through the filter-drier 16 exiting at 31. The majority of fluid in the top tank 29 flows into the accumulator compartment or section 26 at 23D which is the area where the filter-drier assembly 16 passes through the upper first opening 50 located in the common sidewall or end plate 35. The flow is forced downward by a operator baffle 30 provided in the accumulator compartment or section 26 and which extends from the top of the assembly to the bottom thereof. The liquid separates but the gas and entrained oil flow upward and around the upper portion of baffle 30 and into the suction fitting and suction conduit 25. The cycle is then repeated.

The upper first opening 50 provided in the common sidewall or end plate 35 is aligned with an upper second opening 51 provided in the outer sidewall 53 of the outer housing or shell 36. The filter-drier assembly 16 is field removable through the suction line fitting 34. This removable assembly 16 could also be used to function as the separator baffle as will be described later.

The accumulator compartment 26 of the evaporator-accumulator assembly 32 is formed by joining end plate 35 to the side wall 53 of the outer housing or shell 36. The bottom tank 28 is provided with tube 27 which increases the storage capacity of the accumulator section 26 and also reduces the operative charge (and cost) requirement of the evaporator section and thus the system.

The bottom tank 28 is provided with a first lower opening 55 in the common sidewall or end plate 35. The first lower opening 55 is aligned with and is spaced from a second lower opening 57 provided in the outer sidewall 53.

Tube 23B containing the venturi 23C could be a removable tube assembly. The tube 23B is located in the bottom tank 28 and extends through the first and second lower openings 55, 57. It must be sealed by O-ring seals at 15 and 13. Tube 23B has the capacity to house the restrictor 24 if so desired.

It is expected that the evaporator-accumulator assembly 32 including fittings 34 and 36 minus the filter-drier assembly 16 and tube 23B could be brazed in one operation for minimum cost.

Many automotive air conditioning systems are designed for a ½ lb. to 1 lb. refrigerant charge over the critical charge requirement. The accumulator section 26 shown in FIG. 3 along with the storage tube 27 has a capacity of one pound when about half filled. Accumulator section 26 measures one inch by 3 inches by eleven inches approximately.

As mentioned previously the oil bleed hole of the prior art is eliminated in the present invention. Prior art accumulators are approximately 3½ inches in diameter. The smaller cross sectional area of this invention creates more velocity within the accumulator section 26 and more turbulence resulting in more oil entrainment in the suction gas. Also, the warm attached fins create boiling within the accumulator 26 adding to the turbulence. Liquid separation is accomplished by the baffle 30 and the greater distance from the liquid interface to the suction inlet. Also the accumulator 26 will possess less "sloshing" from vehicle movement compared to the prior art. During high load high speed conditions the accumulator 26 will run at a reduced liquid level and further the distance of liquid interface from the suction inlet.

The filter-drier assembly 16 shown in FIG. 3 as described before will also aid in oil return. The openings 17 of this filter-drier assembly 16 are in contact with the fluid in the top tank 29 of the evaporator and absorb liquid refrigerant and oil. This mixture is allowed to flow through the drier medium and exits directly into the suction line 25 at fitting 34. The size of the drier exit hole 31 will be dictated by application. In the case of the system operating at low refrigerant charge the separated oil will have this path through the filter-drier assembly 16 plus be scavenged from the accumulator bottom by refrigerant gas flow between the baffle 30 and the shell 36 of the accumulator section 26. This path at normal refrigerant charge would be sealed by liquid but would become a parallel path flowing at a velocity adequate to lift the oil vertically along the path surface.

By proper design of the restriction in the primary gas flow path in the upper accumulator it can be insured that liquid is not drawn from this secondary path at normal charge conditions and under all normal flow conditions. However, this design allows the flexibility to draw liquid at high flow conditions if desired but not at low speed and idle lower capacity conditions.

In summary, oil return to the compressor 20 at normal charge is primarily by oil entrainment in the suction gas aided by recirculation and turbulence within the accumulator section 26. The filter-drier assembly 16 aids oil return under all charge conditions. Under low charge conditions the secondary flow path is also utilized for this return function.

As alluded to earlier, the filter-drier assembly 16 could be used in place of the upper portion of the baffle 30 to affect liquid separation by obvious placement of openings in its assembly in the area of the accumulator section.

Figure 4:
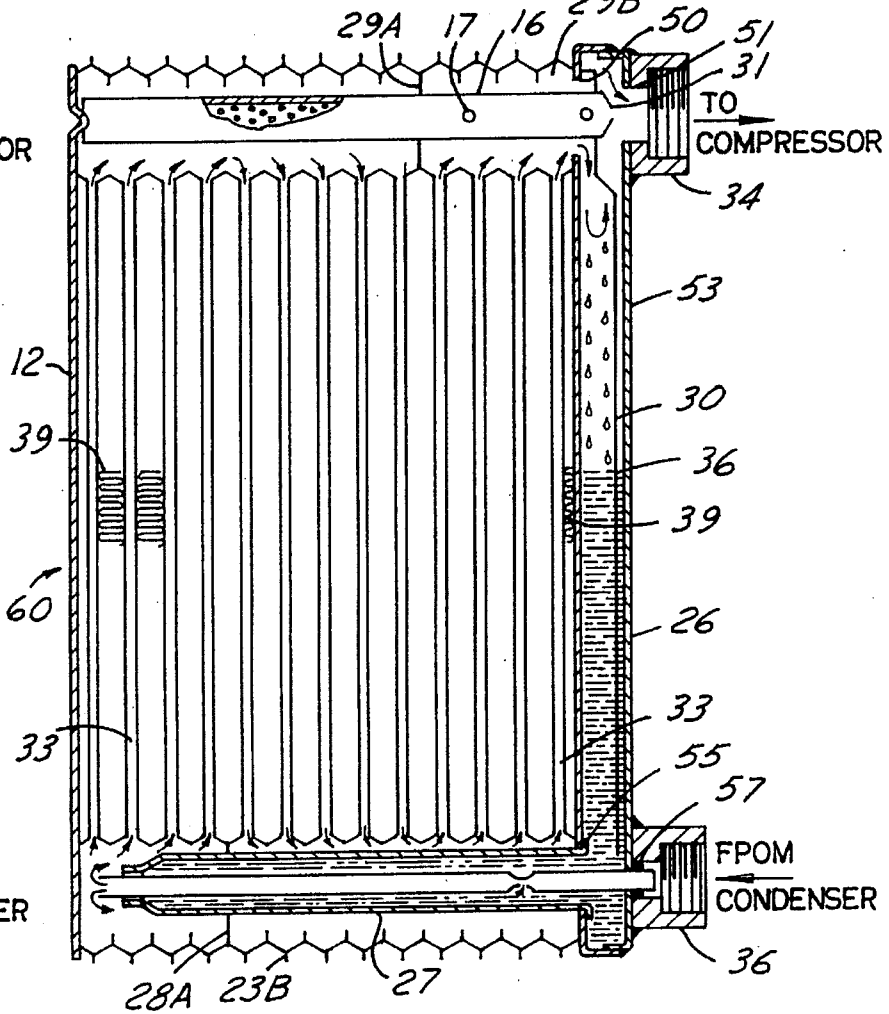
FIG. 4 is a cut-away vertical view of the evaporator-accumulator assembly, similar to FIG. 3, but utilizing a three pass fluid flow path.

FIG. 4 illustrates another embodiment with a vertical flow multiple pass evaporator-accumulator assembly 60. This differs from the evaporator-accumulator assembly 32 of FIG. 3 in that the storage tube 27 passes through the baffle 28A located in the lower evaporator tank 28. This baffle 28A directs the flow upwardly through the channels 33 to the left of the baffle 28A, while blocking the flow to the right side of the baffle 28A. This does not have to be a perfect seal as some refrigerant can bypass the first pass with no harm. The filter-drier assembly 16 must be sealed in the upper evaporator compartment 29 by O-rings 29A to prevent liquid refrigerant from flowing directly into the tank section 29B of the upper evaporator compartment 29.

In operating the liquid or fluid flow from storage tube 23B rises through the channels 33 to the left of baffle 28A and thereafter is directed downwardly through the channels 33 to the left of the O-ring 29. Finally the flow is directed in a third path upwardly through the channels 33 at the right side of the O-ring 29 as shown in FIG. 4. As in the embodiment of FIG. 3 the openings 17 of the filter-drier assembly 16 are in contact with the fluid in the outlet tank or compartment of the evaporator and absorb liquid refrigerant and oil. This mixture is allowed to flow through the drier medium and exits directly into the suction line 25 at the fitting 34.

Figure 5:
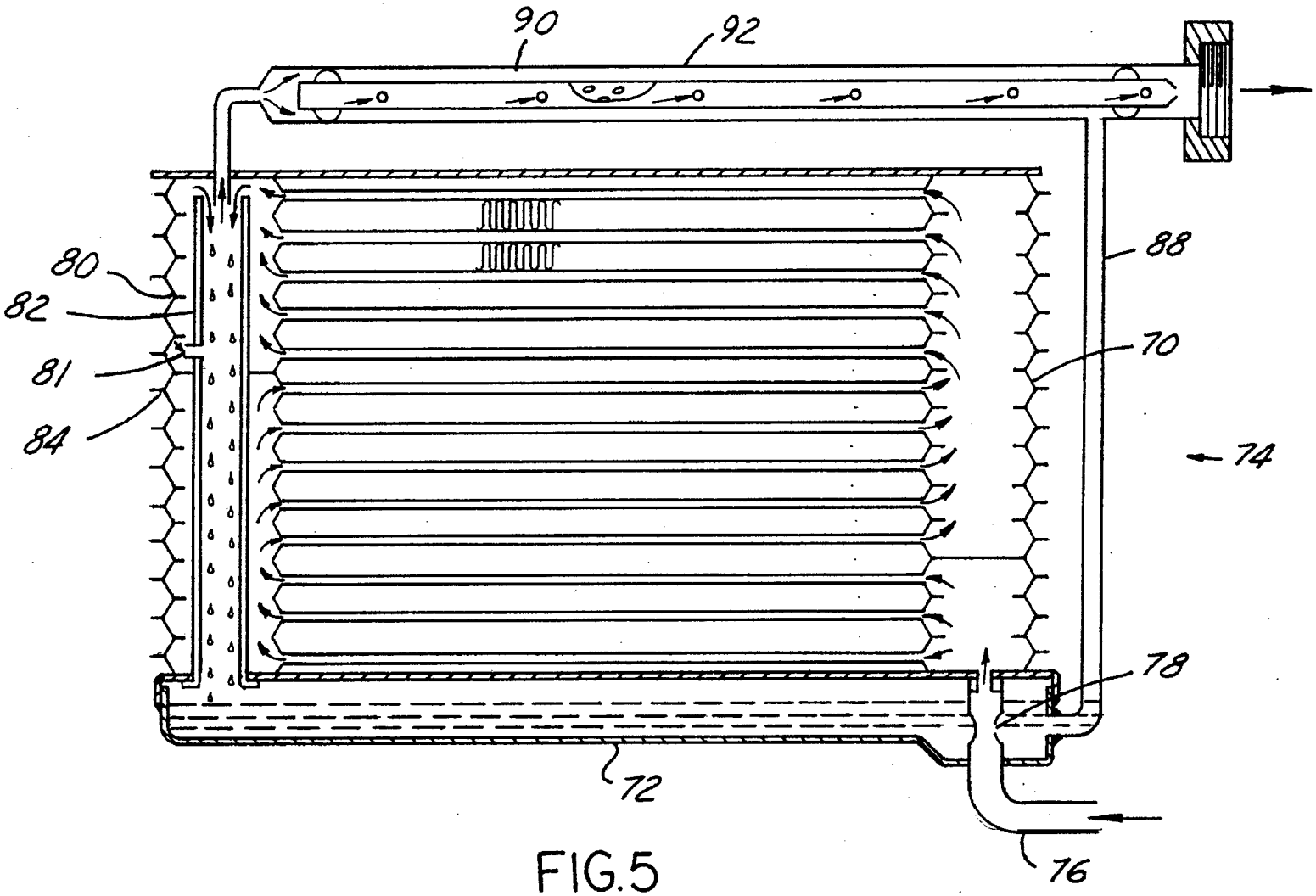
FIG. 5 is a cut-away vertical view of another embodiment of an evaporator-accumulator assembly utilizing a three pass horizontal fluid flow path.

Referring now to FIG. 5, this embodiment uses a horizontal evaporator section 70 of multiple pass design. The accumulator section 72 is at the bottom of the assembly 74. Flow from the restrictor 24 (FIG. 1) enters conduit 76 and flows to the evaporator 70 thru venturi 78. As before the venturi 78 draws refrigerant from the accumulator section 72. The flow (mostly gas) exits in the evaporator tank 80. Some separation of liquid and gas is affected in this chamber. The heavier liquid flowing into the lower opening 81 and the gas to the upper. Further separation is affected within the vertical tube 82 which allows gas to rise and liquid to fall into the accumulator 72. Tube 82 must be sealed at baffle 84. A one inch by three inch by eleven inch accumulator section, which is two-thirds filled with liquid will have approximately a one pound charge tolerance.

Conduit 88 becomes a secondary flow path at low charge drawing oil from the accumulator bottom 72 via gas velocity similar to the method of FIG. 3. The filter drier assembly 90 is installed in an expanded conduit 92 which is part of the assembly and to which the underhood suction line would be attached. This filter drier assembly 90 would tend to operate in a very wet saturated condition when liquid and oil flows from the evaporator. At low charge conditions it would tend to release its oil into the now drier suction gas.

The filter-drier of embodiments of FIGS. 3, 4 and 5 is located in the suction gas flow and with proper filtration material can filter out and hold impurities in greater efficiency than prior art driers which are in the prior art accumulator.

It is believed that in prior art systems at steady state the refrigerant quantity circulated by the compressor is the sum of the liquid vaporized in the evaporator, the flash gas created by the expansion process and the liquid flowing from the evaporator. In this invention this differs as the refrigerant quantity now includes the gases produced in evaporation and expansion plus liquid flow from the accumulator. This differs greatly from the refrigerant flowing out of the evaporator since the recirculation process is involved. So now the coil can be flooded with theoretically no liquid flow to the compressor 20 which would be the ultimate aim of an efficient system.

Since oil must be entrained in the suction gas for lubrication some liquid will also be entrained in this invention as a practical matter. Since the prior art accumulator designs have substantial liquid bleed plus turbulence from flow, vehicle movement, and boiling, it will be relatively easy to reduce the amount of liquid return with this invention.

Prior art fixed restriction systems suffer from transient "starving" of the evaporator in the idle to a high speed driveaway condition. Flow through the restrictor is momentarily reduced while enough liquid is transferred from the accumulator to the condenser to rebalance the system. Refrigerant recirculation alleviates this problem as the extra flow from the accumulator tends to maintain evaporator flow requirements during this condition.

The following is an explanation of why the evaporator size of this invention may be reduced so that the total assembly is equal to or only slightly larger than the prior art evaporator only and still maintain equal system performance.

It is known that a reduction in evaporator size while maintaining a given airflow will produce a capacity loss significantly less than the percentage size decrease. Further, if the given compressor and condenser capacities are maintained then a reduction in evaporator capacity affects the system by approximately ⅓ of this evaporator capacity reduction. From this it can be seen that a 10% reduction in evaporator size would result in less than a 3% reduction in system capacity when the compressor is operated with limited capacity such as low speed and idle. The following performance improvements obtained by this invention should easily negate this small loss.

FIRST, by removing the accumulator from the hot engine compartment unwanted heat transfer to the system is greatly reduced. The surface area of the prior art accumulator is on the order of almost one square foot. The cold accumulator condenses moisture from the hot underhood air. Also, the air under the hood can be 200 degrees F. warmer than the accumulator. Thus, conservatively a heat gain equal to 5% of evaporator capacity can be added during hot idle conditions thereby raising coil temperatures and reducing cooling.

SECOND, the end plate of the accumulator side of the evaporator can now be used to cool the attached core fins. These fins are now somewhat sealed by installation gasketing. The cold accumulator will also be in contact with evaporator air and will add to cooling capacity.

THIRD, less liquid feed to the compressor along with less refrigerant pressure drop from the evaporator section to the compressor will increase system performance as compressor gas pumping capacity will be increased.

FOURTH, there will be a slight benefit from improved refrigerant distribution from the recirculation especially in the single pass evaporator.

If the resultant evaporator core is smaller then the air restriction will increase. Some things can be done to alleviate this. Removal of gasketing normally on the fins adjacent to the end plate, some flow around the cold accumulator, and strategically placed vanes to evenly spread air across the core will result in only a small increase in blower power to maintain airflow of the prior art system.

There may arise a need for more drier capacity than what this invention allows with the core assembly. The additional drier capacity may be placed within an expanded suction conduit which attaches to the accumulator fitting.

I claim:

1. A combined evaporator and suction accumulator assembly for an air conditioning system containing a refrigerant comprising:

an integral housing having a plurality of compartments including an evaporator compartment containing evaporator means, a bottom compartment located beneath said evaporator compartment and forming a bottom tank, a top compartment located above said evaporator compartment and forming a top tank, said compartments having generally the same length and a common sidewall, an accumulator compartment utilizing the outer surface of said common sidewall and extending from said top tank to said bottom tank, said accumulator compartment forming a reservoir having an outer sidewall spaced from said common sidewall, said top tank having an upper first opening in said common sidewall communicating with the interior of said accumulator compartment, an upper second opening provided in the outer sidewall of said accumulator compartment, said first and second upper openings being aligned, a baffle located in said accumulator compartment between said first and second upper openings, said bottom tank having a first lower opening in said con, on sidewall, a second lower opening in said outer sidewall spaced from said first lower opening;

a tube located in said bottom tank and extending through said first and second lower openings, and a venturi in said tube communicating with the reservoir in said accumulator compartment and providing refrigerant recirculation within said evaporator and suction accumulator assembly.

2. The combined evaporator and suction accumulator assembly of claim 1, wherein said evaporator means has a series of plate-fin constructions which are spaced apart to define channels and permit flow through the channels from said bottom tank to said top tank.

3. The combined evaporator and suction accumulator assembly of claim 2, wherein the channels are arranged vertically and provide a single pass for fluid flow.

4. The combined evaporator and suction accumulator assembly of claim 3, wherein the channels are arranged vertically and provide a three way pass for fluid flow.

5. The combined evaporator and suction accumulator assembly of claim 1, wherein a field removable filter-drier assembly is located in said top tank and through which some refrigerant flows.

6. A compact integral evaporator and accumulator assembly comprising a plate-fin evaporator having a top tank and a bottom tank, said evaporator utilizing one end plate and a shell joined to said one end plate to form an accumulator.

7. The assembly of claim 6, wherein a tube is inserted in said bottom tank of said evaporator to increase storage capacity of said accumulator.

8. The assembly of claim 6, wherein a field removable filter drier is located in the top tank of said accumulator.

9. The assembly of claim 7, wherein a venturi is located in said tube for liquid recirculation within the accumulator and evaporator assembly.

10. The assembly of claim 6, wherein a liquid-vapor separation baffle is provided in said accumulator.

11. The assembly of claim 6, wherein a tube or baffle is provided in said accumulator to achieve a secondary gas flow path at low refrigerant charge conditions to aid in oil return to a compressor.

12. The assembly of claim 8, wherein said filter-drier helps to return oil to a compressor.

13. The assembly of claim 7, wherein said tube reduces operating charge in the evaporator by taking up space within said evaporator.

14. The assembly of claim 6, wherein a venturi is provided in said evaporator to increase heat transfer efficiency by recirculation of refrigerant.

15. The assembly of claim 6, wherein an expansion device is installed therein.

* * * * *